US007343930B2

(12) United States Patent
Rosko

(10) Patent No.: US 7,343,930 B2
(45) Date of Patent: Mar. 18, 2008

(54) SPRAYER WITH NON-FAUCET CONTROL

(75) Inventor: M. Scot Rosko, Greenwood, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 274 days.

(21) Appl. No.: 11/003,312

(22) Filed: Dec. 3, 2004

(65) Prior Publication Data

US 2006/0117477 A1 Jun. 8, 2006

(51) Int. Cl.
*F16K 11/10* (2006.01)

(52) U.S. Cl. ..... 137/597; 4/676; 4/678; 137/599.03

(58) Field of Classification Search ..... 137/597, 137/599.03; 4/676, 678
See application file for complete search history.

(56) References Cited

U.S. PATENT DOCUMENTS

| | | | | |
|---|---|---|---|---|
| 603,144 | A | | 4/1898 | Kellerman et al. |
| 1,123,189 | A | | 12/1914 | Hannaford |
| 1,647,983 | A | | 11/1927 | Bloch |
| 2,314,071 | A | | 3/1943 | Bucknell et al. |
| 2,416,747 | A | | 3/1947 | Geimer |
| 2,566,878 | A | | 9/1951 | Fahrenkrog et al. |
| 2,567,176 | A | | 9/1951 | Ballard |
| 2,584,943 | A | * | 2/1952 | Thomas ..... 239/458 |
| 2,956,579 | A | | 10/1960 | Moore et al. |
| 3,144,878 | A | | 8/1964 | Williams |
| 3,341,132 | A | | 9/1967 | Parkison |
| 3,524,591 | A | | 8/1970 | Samuels et al. |
| 3,545,473 | A | | 12/1970 | Moia |
| 3,588,040 | A | | 6/1971 | Ward |
| 3,591,083 | A | | 7/1971 | O'Rear |
| 3,656,503 | A | | 4/1972 | Ward |
| 3,682,392 | A | | 8/1972 | Kint |
| 3,698,644 | A | | 10/1972 | Nystuen |
| 3,722,525 | A | | 3/1973 | Epple |
| 3,768,735 | A | | 10/1973 | Ward |
| 3,786,995 | A | | 1/1974 | Manoogian et al. |
| 3,851,825 | A | | 12/1974 | Parkison et al. |
| 3,902,671 | A | | 9/1975 | Symmons |
| 3,944,141 | A | | 3/1976 | Siczek |
| 4,029,119 | A | | 6/1977 | Klieves |
| 4,119,276 | A | | 10/1978 | Nelson |
| 4,187,986 | A | | 2/1980 | Petrovic |
| 4,221,337 | A | | 9/1980 | Shames et al. |
| 4,224,962 | A | | 9/1980 | Orszullok |
| 4,257,460 | A | | 3/1981 | Paranay et al. |
| 4,396,156 | A | | 8/1983 | Southworth et al. |
| 4,398,669 | A | | 8/1983 | Fienhold |
| 4,461,052 | A | | 7/1984 | Mostul |
| 4,524,911 | A | | 6/1985 | Roznieck i |
| 4,534,512 | A | | 8/1985 | Chow et al. |

(Continued)

FOREIGN PATENT DOCUMENTS

| | | |
|---|---|---|
| DE | 3306947 | 8/1984 |

(Continued)

*Primary Examiner*—Stephen M. Hepperle
(74) *Attorney, Agent, or Firm*—Baker & Daniels LLP

(57) ABSTRACT

A fluid delivery system including a faucet and a hand-held sprayer is disclosed. The temperature of the water provided by the faucet is controlled independent of the temperature of the water provided by the hand-held sprayer. The temperature of the water provided by the hand-held sprayer may be controlled by a valve supported by the hand-held sprayer. The temperature of the water provided by the hand-held sprayer may be controlled through a control member supported by the hand-held sprayer.

17 Claims, 6 Drawing Sheets

U.S. PATENT DOCUMENTS

| | | | | |
|---|---|---|---|---|
| 4,541,568 | A | | 9/1985 | Lichfield |
| 4,581,707 | A | | 4/1986 | Millar |
| 4,582,253 | A | | 4/1986 | Gerdes |
| 4,606,370 | A | | 8/1986 | Geipel et al. |
| 4,618,100 | A | | 10/1986 | White et al. |
| 4,619,403 | A | | 10/1986 | Goldney et al. |
| 4,629,124 | A | | 12/1986 | Gruber |
| 4,650,120 | A | | 3/1987 | Kress |
| 4,666,085 | A | | 5/1987 | Liaw |
| 4,696,322 | A | | 9/1987 | Knapp et al. |
| 4,703,893 | A | | 11/1987 | Gruber |
| 4,776,517 | A | | 10/1988 | Heren |
| 4,785,998 | A | | 11/1988 | Takagi |
| RE32,981 | E | | 7/1989 | Marty |
| 4,909,443 | A | | 3/1990 | Takagi |
| 4,927,115 | A | | 5/1990 | Bahroos et al. |
| 4,934,402 | A | | 6/1990 | Tarney et al. |
| 4,955,546 | A | | 9/1990 | Liaw |
| 4,997,131 | A | | 3/1991 | Heren |
| 5,014,919 | A | | 5/1991 | Knapp |
| 5,052,587 | A | | 10/1991 | Graves |
| 5,069,241 | A | | 12/1991 | Hochstrasse |
| 5,093,943 | A | | 3/1992 | Wei |
| 5,100,055 | A | | 3/1992 | Rokitenetz et al. |
| 5,143,299 | A | | 9/1992 | Simonetti et al. |
| 5,145,114 | A | | 9/1992 | Monch |
| 5,158,234 | A | | 10/1992 | Magnenat et al. |
| 5,160,092 | A | | 11/1992 | Rose et al. |
| 5,172,866 | A | | 12/1992 | Ward |
| 5,184,777 | A | | 2/1993 | Magnenat et al. |
| 5,201,468 | A | | 4/1993 | Freier et al. |
| 5,232,162 | A | | 8/1993 | Chih |
| 5,255,848 | A | | 10/1993 | Rhodehouse |
| 5,323,968 | A | | 6/1994 | Kingston et al. |
| 5,333,792 | A | | 8/1994 | Wang |
| 5,348,228 | A | | 9/1994 | Wang |
| 5,348,231 | A | | 9/1994 | Arnold et al. |
| 5,370,314 | A | | 12/1994 | Gebauer et al. |
| 5,383,604 | A | | 1/1995 | Boesch |
| 5,398,872 | A | | 3/1995 | Joubran |
| 5,433,384 | A | | 7/1995 | Chan et al. |
| 5,445,182 | A | | 8/1995 | Sturman et al. |
| 5,467,927 | A | | 11/1995 | Lee |
| 5,477,885 | A | | 12/1995 | Knapp |
| 5,507,314 | A | | 4/1996 | Knapp |
| 5,630,548 | A | | 5/1997 | Chih |
| 5,634,220 | A | | 6/1997 | Chiu |
| 5,647,537 | A | | 7/1997 | Bergmann |
| 5,649,562 | A | | 7/1997 | Sturman et al. |
| 5,662,273 | A | | 9/1997 | Chih |
| 5,662,276 | A | | 9/1997 | Ko |
| 5,669,558 | A | | 9/1997 | Ichel |
| 5,707,011 | A | | 1/1998 | Bosio |
| 5,722,597 | A | | 3/1998 | Guo |
| 5,732,884 | A | | 3/1998 | Jauner |
| 5,735,467 | A | | 4/1998 | Lee |
| 5,743,286 | A | * | 4/1998 | Ko ..... 137/597 |
| 5,772,120 | A | | 6/1998 | Huber |
| 5,794,854 | A | | 8/1998 | Yie |
| 5,806,770 | A | | 9/1998 | Wang |
| 5,806,771 | A | | 9/1998 | Loschelder et al. |
| 5,813,435 | A | | 9/1998 | Knapp |
| 5,823,229 | A | | 10/1998 | Bertrand et al. |
| 5,829,681 | A | | 11/1998 | Hamel et al. |
| 5,853,130 | A | | 12/1998 | Ellsworth |
| 5,858,215 | A | | 1/1999 | Burchard et al. |
| 5,873,531 | A | | 2/1999 | Wang |
| 5,887,796 | A | | 3/1999 | Dimmer |
| 5,906,319 | A | | 5/1999 | Crowl |
| 5,918,816 | A | | 7/1999 | Huber |
| 5,927,333 | A | | 7/1999 | Grassberger |
| 5,937,905 | A | | 8/1999 | Santos |
| 5,944,141 | A | | 8/1999 | Kochan et al. |
| 5,971,299 | A | | 10/1999 | Loschelder et al. |
| 5,975,429 | A | | 11/1999 | Jezek |
| 5,975,432 | A | | 11/1999 | Han |
| 5,984,207 | A | | 11/1999 | Wang |
| 6,000,626 | A | | 12/1999 | Futo et al. |
| 6,000,637 | A | | 12/1999 | Duncan |
| 6,007,003 | A | | 12/1999 | Wang |
| 6,016,975 | A | | 1/2000 | Amaduzzi |
| 6,045,062 | A | | 4/2000 | Bosio |
| 6,059,200 | A | | 5/2000 | Chou |
| 6,076,743 | A | | 6/2000 | Fan |
| 6,085,790 | A | | 7/2000 | Humpert et al. |
| 6,129,294 | A | | 10/2000 | Wang |
| 6,145,757 | A | | 11/2000 | Knapp |
| 6,151,729 | A | | 11/2000 | Yean |
| 6,158,152 | A | | 12/2000 | Nathenson et al. |
| 6,164,566 | A | | 12/2000 | Hui-Chen |
| 6,173,910 | B1 | | 1/2001 | Yean |
| 6,173,911 | B1 | | 1/2001 | Hui-Chen |
| 6,179,130 | B1 | | 1/2001 | Nguyen et al. |
| 6,216,965 | B1 | | 4/2001 | Chao |
| 6,220,297 | B1 | | 4/2001 | Marty et al. |
| 6,230,989 | B1 | | 5/2001 | Haverstraw et al. |
| 6,234,192 | B1 | | 5/2001 | Esche et al. |
| 6,247,654 | B1 | | 6/2001 | Kuo |
| D445,874 | S | | 7/2001 | Czerwinski, Jr. et al. |
| 6,254,016 | B1 | | 7/2001 | Chao |
| 6,260,772 | B1 | | 7/2001 | Hennemann, Jr. et al. |
| 6,260,774 | B1 | | 7/2001 | Erickson |
| 6,290,147 | B1 | | 9/2001 | Bertrand |
| 6,296,011 | B1 | | 10/2001 | Esche et al. |
| 6,302,339 | B1 | | 10/2001 | Chou |
| 6,305,619 | B1 | | 10/2001 | Thurn |
| 6,341,738 | B1 | | 1/2002 | Coles |
| 6,367,710 | B2 | | 4/2002 | Fan |
| 6,367,711 | B1 | | 4/2002 | Benoist |
| 6,368,503 | B1 | | 4/2002 | Williamson et al. |
| 6,370,713 | B2 | | 4/2002 | Bosio |
| 6,382,529 | B1 | | 5/2002 | Wu |
| 6,415,958 | B1 | | 7/2002 | Donley |
| 6,427,931 | B1 | | 8/2002 | Guo |
| 6,431,468 | B1 | | 8/2002 | Brown et al. |
| 6,454,186 | B2 | | 9/2002 | Haverstraw et al. |
| 6,454,187 | B1 | | 9/2002 | Wang |
| 6,460,782 | B1 | | 10/2002 | Wang |
| 6,467,104 | B1 | | 10/2002 | Shieh |
| 6,471,141 | B2 | | 10/2002 | Smith et al. |
| 6,484,953 | B2 | | 11/2002 | Frier |
| 6,502,768 | B2 | | 1/2003 | Chang |
| 6,508,415 | B2 | | 1/2003 | Wang |
| 6,520,427 | B1 | | 2/2003 | Chen |
| 6,540,159 | B1 | | 4/2003 | Wang |
| 6,540,163 | B1 | | 4/2003 | Huang |
| 6,561,210 | B2 | | 5/2003 | Hsieh et al. |
| 6,561,441 | B1 | | 5/2003 | Hsieh |
| 6,568,605 | B1 | | 5/2003 | Chen |
| 6,575,387 | B1 | | 6/2003 | Baker |
| 6,592,057 | B1 | | 7/2003 | Ericksen et al. |
| 6,595,440 | B2 | | 7/2003 | Moriarity et al. |
| 6,612,507 | B1 | | 9/2003 | Meyer et al. |
| 6,622,945 | B1 | | 9/2003 | Wu |
| 6,634,573 | B2 | | 10/2003 | Bosch et al. |
| 6,641,060 | B2 | | 11/2003 | Bratolli et al. |
| 6,641,061 | B1 | | 11/2003 | Hsieh |
| 6,644,333 | B2 | * | 11/2003 | Gloodt ..... 137/597 |
| 6,659,373 | B1 | | 12/2003 | Heren et al. |
| 6,663,022 | B1 | | 12/2003 | Baker |
| 6,685,110 | B2 | | 2/2004 | Wang et al. |
| 6,691,933 | B1 | | 2/2004 | Bosio |
| 6,691,937 | B2 | | 2/2004 | Heren et al. |
| 6,719,219 | B1 | | 4/2004 | Wang |

| | | | |
|---|---|---|---|
| 6,738,996 | B1 | 5/2004 | Malek et al. |
| 6,739,523 | B2 | 5/2004 | Haverstraw et al. |
| 6,749,135 | B2 | 6/2004 | Groblebe et al. |
| 6,757,921 | B2 | 7/2004 | Esche |
| 6,796,515 | B2 | 9/2004 | Heren et al. |
| 6,808,130 | B1 | 10/2004 | Ouyoung |
| 6,808,131 | B2 | 10/2004 | Bosio |
| 6,811,099 | B2 | 11/2004 | Krestine et al. |
| 6,860,438 | B1 | 3/2005 | Huang |
| 6,866,208 | B2 | 3/2005 | Kao |
| 6,880,768 | B2 | 4/2005 | Lau |
| 6,915,967 | B1 | 7/2005 | Chen |
| 6,921,032 | B2 | 7/2005 | Habermacher et al. |
| 6,945,474 | B1 | 9/2005 | Chen |
| 6,962,298 | B1 | 11/2005 | Martin |
| 6,981,661 | B1 | 1/2006 | Chen |
| 7,000,626 | B1 | 2/2006 | Cress |
| 7,000,854 | B2 | 2/2006 | Malek et al. |
| 2001/0020302 | A1 | 9/2001 | Bosio |
| 2002/0185553 | A1 | 12/2002 | Benstead et al. |
| 2002/0190141 | A1 | 12/2002 | Huang |
| 2003/0042331 | A1 | 3/2003 | Lu |
| 2003/0042337 | A1 | 3/2003 | Liang et al. |
| 2003/0125842 | A1* | 7/2003 | Chang et al. ..... 700/282 |
| 2003/0127541 | A1 | 7/2003 | Marino |
| 2003/0173423 | A1 | 9/2003 | Haenlein et al. |
| 2003/0189111 | A1 | 10/2003 | Heren et al. |
| 2004/0010848 | A1 | 1/2004 | Esche |
| 2004/0088786 | A1 | 5/2004 | Malek et al. |
| 2004/0112985 | A1 | 6/2004 | Malek et al. |
| 2004/0155460 | A1 | 8/2004 | Nobili |
| 2004/0164183 | A1 | 8/2004 | Nobili |
| 2004/0173688 | A1 | 9/2004 | Gloodt |
| 2004/0222320 | A1 | 11/2004 | Wu |
| 2004/0227014 | A1 | 11/2004 | Williams et al. |
| 2005/0103897 | A1 | 5/2005 | Cannon et al. |
| 2005/0121542 | A1 | 6/2005 | Su Lim |
| 2005/0145554 | A1 | 7/2005 | Cunningham et al. |
| 2005/0161533 | A1 | 7/2005 | Nobili |
| 2005/0178857 | A1 | 8/2005 | Roman |
| 2005/0178858 | A1 | 8/2005 | Roman |
| 2005/0189438 | A1 | 9/2005 | Bosio |
| 2005/0242210 | A1 | 11/2005 | Heren et al. |
| 2006/0016912 | A1 | 1/2006 | Nobili |
| 2006/0022071 | A1 | 2/2006 | Burnworth et al. |
| 2006/0117477 | A1 | 6/2006 | Rosko |
| 2006/0214016 | A1 | 9/2006 | Erdely et al. |
| 2006/0255167 | A1 | 11/2006 | Vogel et al. |

FOREIGN PATENT DOCUMENTS

| | | | |
|---|---|---|---|
| DE | 3643320 | | 7/1988 |
| EP | 0 251 990 | | 1/1988 |
| EP | 0 337 367 | A2 | 10/1989 |
| EP | 0 809 539 | | 12/1997 |
| EP | 0 933 136 | | 8/1999 |
| EP | 0 975 432 | | 2/2000 |
| EP | 1 132 141 | | 9/2001 |
| EP | 1 354 634 | | 10/2003 |
| EP | 1 418 007 | | 5/2004 |
| EP | 1 598 116 | | 11/2005 |
| GB | 1452974 | | 10/1976 |
| GB | 1 555 003 | | 11/1979 |
| GB | 2 171 175 | A | 8/1986 |
| JP | 02-052061 | | 2/1990 |
| JP | 10230192 | | 9/1998 |
| JP | 11021956 | A | 1/1999 |
| JP | 2000027247 | A | 1/2000 |
| WO | WO 80/01940 | | 9/1980 |
| WO | WO 86/06654 | | 11/1986 |
| WO | WO 96/25237 | | 8/1996 |
| WO | WO 00/32314 | | 6/2000 |
| WO | WO 2005/018814 | | 3/2005 |
| WO | WO 2005/115554 | | 12/2005 |

* cited by examiner

SPRAYER WITH NON-FAUCET CONTROL

BACKGROUND AND SUMMARY OF THE INVENTION

The present invention relates to a fluid delivery system and, more particularly, to a fluid delivery system including a faucet and a hand-held sprayer.

Fluid delivery systems including a faucet and a hand-held sprayer are known in the art. Such systems typically include a diverter valve coupled to the faucet for switching water flow between a delivery spout of the faucet and a spray outlet of the hand-held sprayer. Hot and cold water supplies are fluidly coupled to at least one control valve of the faucet which controls both the flow rate and the temperature of water delivered from the faucet or the hand-held sprayer, as selected by the diverter valve. As such, the flow rate and the temperature of water delivered from the hand-held sprayer are dependant upon operation of the control valve of the faucet. In other words, the flow and the temperature of water delivered from the hand-held sprayer is controlled by operation of the faucet and not by the hand-held sprayer itself.

According to an illustrative embodiment of the present invention, a fluid delivery system includes a faucet having a delivery spout, and a hand-held sprayer having a spray outlet coupled to a housing. The faucet further includes at least one valve fluidly coupled to the delivery spout, a hot water supply, and a cold water supply. The valve of the faucet is configured to control the temperature of water supplied to the delivery spout. The hand-held sprayer further includes at least one valve fluidly coupled to the spray outlet, the hot water supply, and the cold water supply. The valve of the hand-held sprayer is configured to control the temperature of water supplied to the spray outlet independent of the valve of the faucet.

According to a further illustrative embodiment of the present invention, a hand-held fluid delivery device includes a housing configured to be held by the hand of a user, a spray outlet supported by the housing, and an inlet supported by the housing. At least one flexible tubular member is configured to fluidly couple the inlet to a hot water supply and a cold water supply. A valve assembly is received within the housing intermediate the spray outlet and the inlet. An actuator is supported by the housing and is operably coupled to the valve assembly for controlling the flow of water to the spray outlet. A control member is supported by the housing and is operably coupled to the valve assembly for controlling the temperature of water to the spray outlet.

According to yet another illustrative embodiment of the present invention, a method of delivering fluid comprises the steps of providing a delivery spout and a hand-held sprayer, controlling the flow of water delivered from the delivery spout, and controlling the flow of water delivered from the hand-held sprayer independently from the flow of water delivered from the delivery spout. The method further includes the step of controlling the temperature of the water delivered from the delivery spout, and controlling the temperature of the water delivered from the hand-held sprayer independently from the temperature of the water delivered from the delivery spout.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
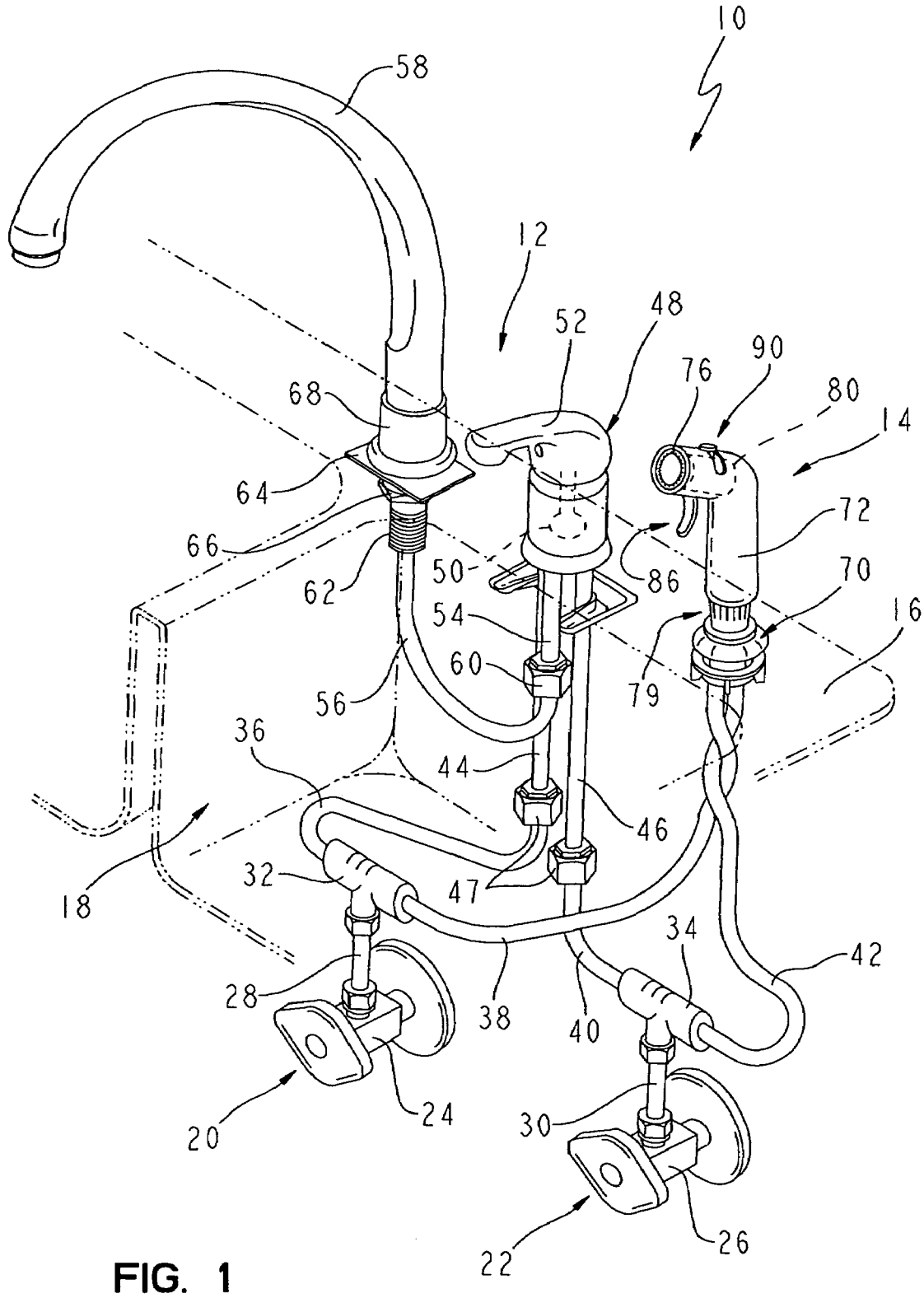
FIG. 1 is a perspective view of an illustrative embodiment fluid delivery system according to the present invention.

Referring initially to FIG. 1, a fluid delivery system 10 according to an illustrative embodiment of the present invention includes a faucet 12 and a hand-held sprayer 14 supported by a mounting or sink deck 16. The faucet 12 and the hand-held sprayer 14 are configured to supply water to a sink or basin 18 extending downwardly from the sink deck 16.

Water is supplied to the fluid delivery system 10 from a hot water supply 20 and a cold water supply 22. The hot water supply 20 and the cold water supply 22 are illustratively coupled to conventional hot and cold water sources (not shown), such as a hot water heater and a municipal water source, respectively. The hot water supply 20 and cold water supply 22 may include conventional valves 24 and 26 to control the flow of hot and cold water to the fluid delivery system 10.

Figure 2:
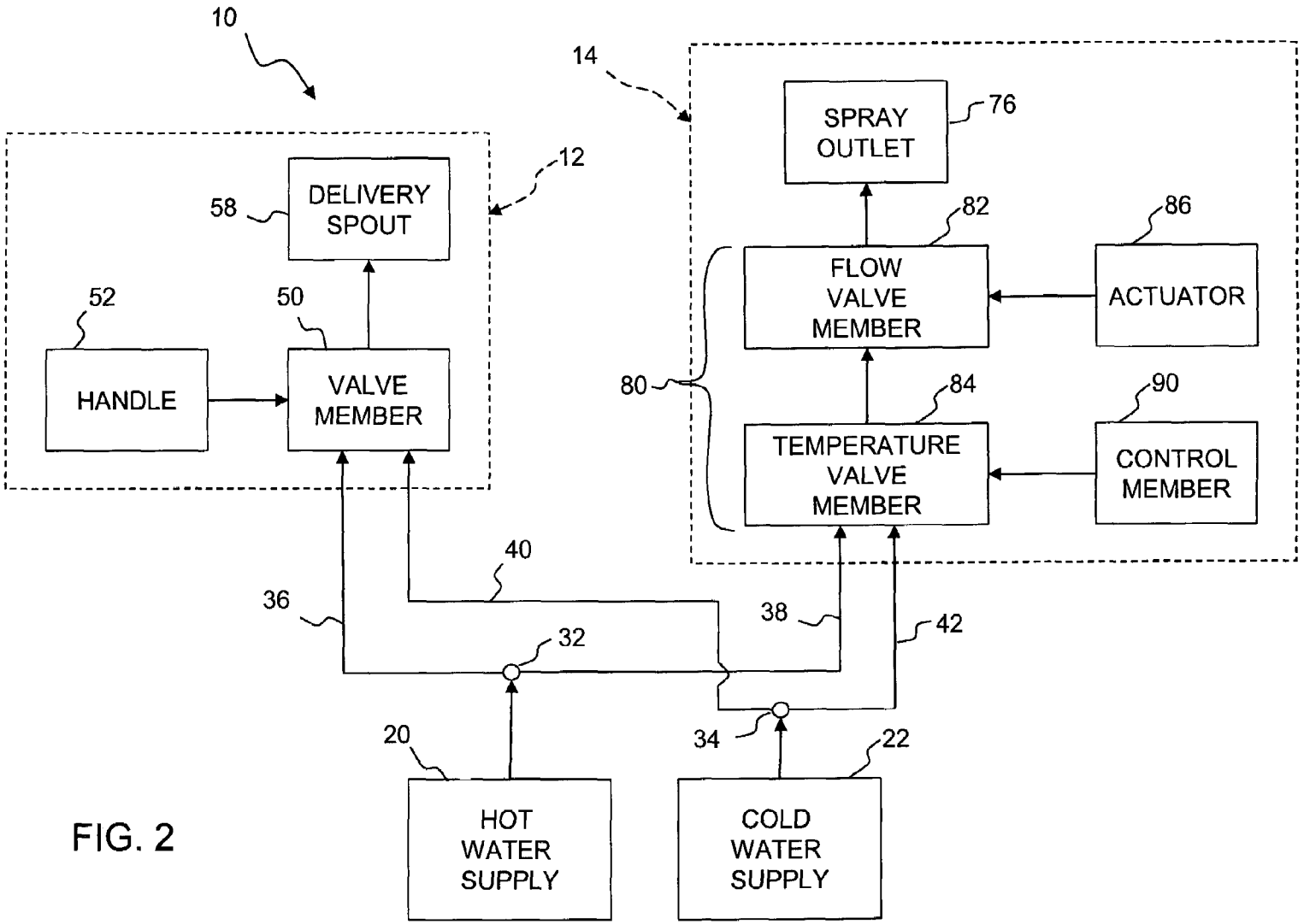
FIG. 2 is a block diagram of the illustrative embodiment fluid delivery system of FIG. 1.

Referring now to FIGS. 1 and 2, hot and cold supply lines 28 and 30 fluidly couple the hot water supply 20 and cold water supply 22 to first and second connectors or splitters 32 and 34, respectively. Illustratively, the connectors 32 and 34 are configured to split each supply line 28, 30 into multiple lines. More particularly, the connectors 32 and 34 are configured to connect the hot and cold supply lines 28 and 30 to distribution lines 36, 38, 40, and 42. The distribution lines include a first set of hot and cold tubular members 36 and 40 fluidly coupling the faucet 12 to the hot water supply 20 and the cold water supply 22. Likewise, the distribution lines include a second set of hot and cold tubular members 38 and 42 fluidly coupling the hand-held sprayer 14 to the hot water supply 20 and the cold water supply 22.

First hot water distribution line 36 fluidly couples the first connector 32 to a first or hot input supply tube 44 of the faucet 12. Similarly, first cold water distribution line 40 fluidly couples the second connector 34 to a second or cold input tube 46 of faucet 12. Conventional fluid connectors 47 may be utilized to secure the distribution lines 36 and 40 to the input tubes 44 and 46. The input tubes 44 and 46 are fluidly coupled to a control valve 48. In the illustrative embodiment of FIG. 1, the control valve 48 comprises a ball valve member 50 operably coupled to a single handle 52. The ball valve member 50 may be of conventional design as illustrated in any of U.S. Pat. No. 5,507,314, U.S. Pat. No. 5,813,435 and U.S. Pat. No. 5,927,333, all of which are assigned to the assignee of the present invention and are expressly incorporated by reference herein. While a ball valve member 50 is used in the illustrative embodiment, it should be appreciated that other valve members may be substituted therefor.

The valve 48 controls the flow rate and the temperature of water supplied to an output tube 54 by adjusting the mixture, along with the flow rate, of hot and cold water provided by the input tubes 44 and 46. A connecting line 56 fluidly couples the output tube 54 to a delivery spout 58. Conventional fluid connectors 60 and 62 may be utilized to secure the opposing ends of connecting line 56 to the output tube 54 and the delivery spout 58, respectively. As further illustrated in FIG. 1, the delivery spout 58 is secured to the sink deck 16 through use of a mounting plate 64 and a securing nut 66. The delivery spout 58 may be supported for rotating movement about a swivel connection 68.

Figure 3:
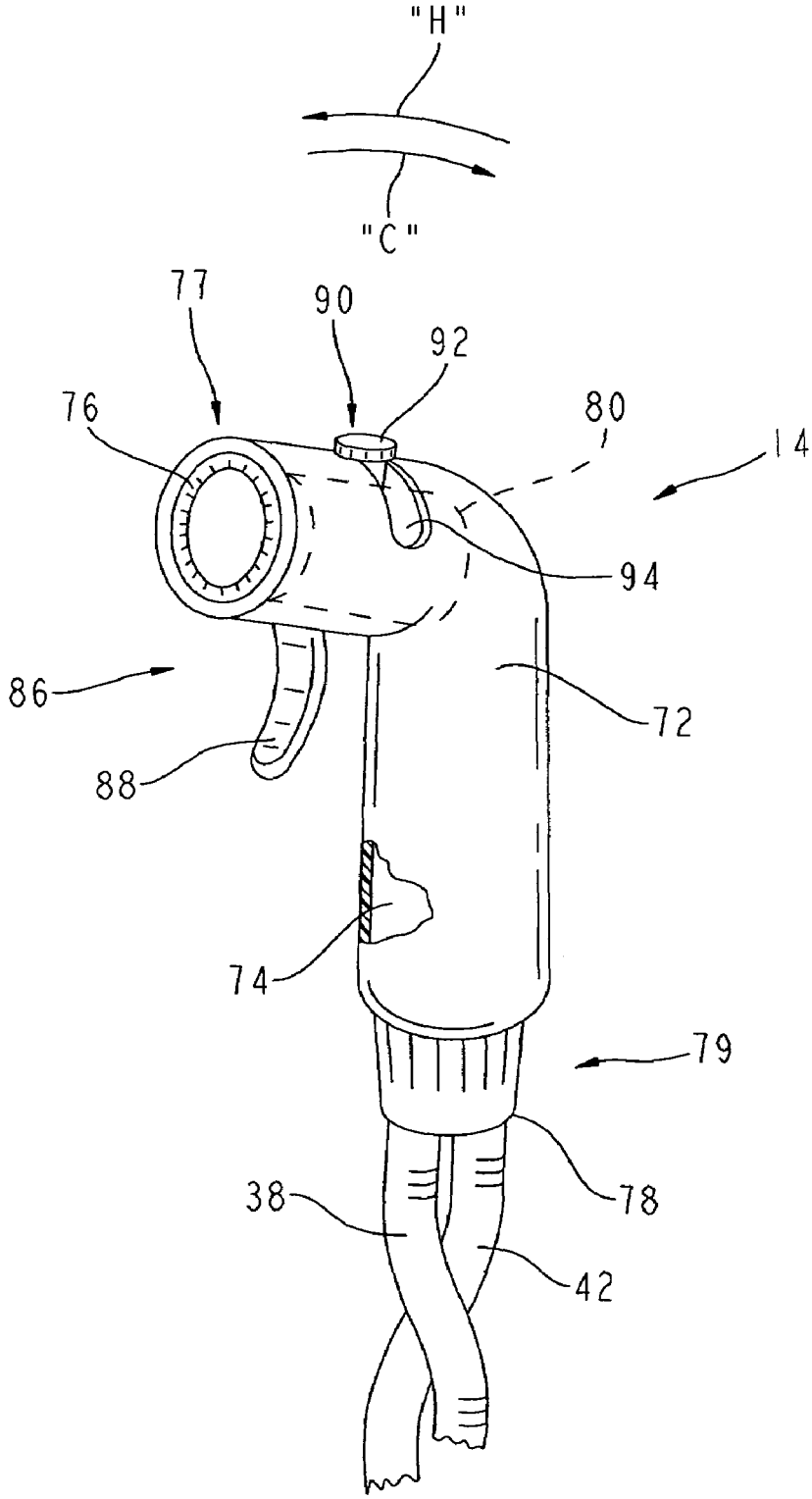
FIG. 3 is a perspective view, with a partial cut-away, of an illustrative embodiment hand-held sprayer according to the present invention.

With reference to FIGS. 1-3, second hot water distribution line 38 and second cold water distribution line 42 fluidly couple the first connector 32 and the second connector 34, respectively, to the hand-held sprayer 14. The distribution lines 38 and 42 are illustratively flexible tubes which are configured to slidably pass through a bushing 70 secured to the sink deck 16. The hand-held sprayer 14 includes a housing 72 defining a fluid chamber 74 (FIG. 3). A spray outlet 76 is coupled to a first end 77 of the housing 72 and may comprise a nozzle configured to direct water outwardly from the fluid chamber 74. An inlet 78 is supported by a second end 79 of the housing 72 and is fluidly coupled to the distribution lines 38 and 42. The second end 79 of the housing 72 is configured to be removably supported within the bushing 70. As such, the sprayer 14 may be moved by the user relative to the basin 18 while remaining fluidly coupled to the water supplies 20 and 22.

A control valve 80 is positioned within the fluid chamber 74 of the housing 72 and is configured to control the flow of water and the temperature of water delivered to the spray outlet 76. In the illustrative embodiment of FIGS. 1 and 2, the control valve 80 includes a flow valve member 82 and a temperature valve member 84. The flow valve member 82 may be of conventional design and is configured to control the flow of water delivered to the spray outlet 76. The flow valve member 82 may be of a two position type providing either "on" or "off" operation, or flow of water. Alternatively, the flow valve member 82 may be configured to control or adjust the flow rate of water delivered to the spray outlet 76. The flow valve member 82 may be of the type disclosed in U.S. Pat. No. 4,927,115 or U.S. Pat. No. 5,014,919, which are assigned to the assignee of the present invention and are expressly incorporated by reference herein. The temperature valve member 84 is in fluid communication with the flow valve member 82 and illustratively controls the mixing of hot and cold water from the distribution lines 38 and 42, respectively.

An actuator 86 is operably coupled to the flow valve member 82 and is illustratively configured to be moved by a user holding the housing 72 of the sprayer 14. More particularly, the actuator 86 illustratively includes a trigger 88 pivotally supported by the housing 72 and configured to be gripped by the fingers of a user. By moving the trigger 88 toward the housing 72, the flow valve member 82 opens to provide water flow to the spray outlet 76.

Figure 4:
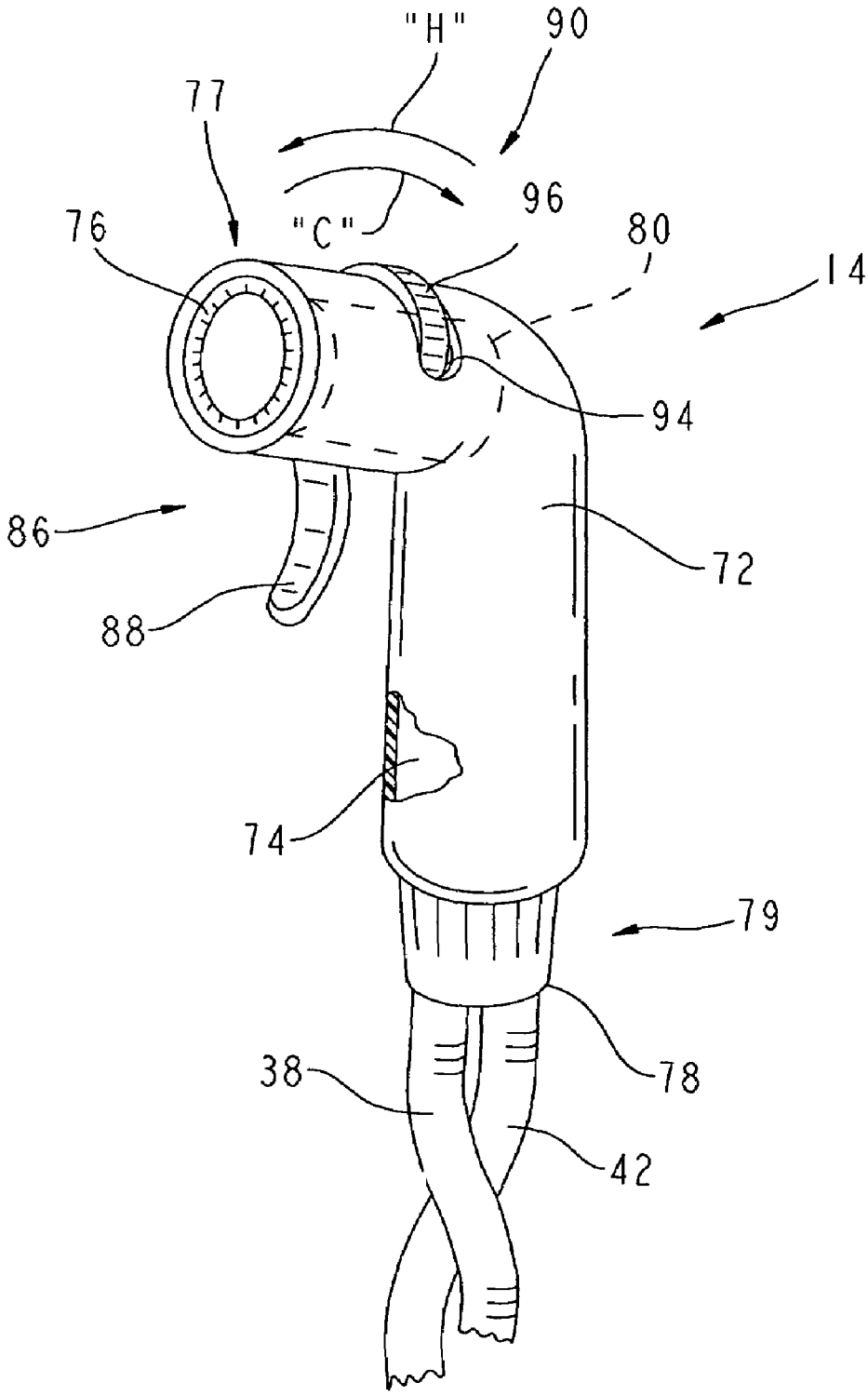
FIG. 4 is a perspective view, with a partial cut-away, of a further illustrative embodiment hand-held sprayer according to the present invention.

A control member 90 is operably coupled to the temperature valve member 84 and is illustratively supported for movement relative to the housing 72. In the illustrative embodiments of FIGS. 1 and 3, the control member 90 comprises a lever 92 received within a slot 94 formed in the housing 72 and configured to be pivoted between hot and cold positions. More particularly, the lever 92 may be pivoted in a first direction, illustratively identified as arrow "H" in FIG. 3, in order to increase the temperature of water delivered to the spray outlet 76. Similarly, the lever 92 may be pivoted in a second direction, illustratively identified as arrow "C" in FIG. 3, in order to decrease the temperature of water delivered to the spray outlet 76. In an alternative embodiment as illustrated in FIG. 4, the control member 90 comprises a disk or wheel 96 rotably supported within the slot 94 of the housing 72. The wheel 96 may be rotated in a first direction, illustratively identified as arrow "H" in FIG. 4, in order to increase the temperature of water delivered to the spray outlet 76. Similarly, the wheel 96 may be rotated in a second direction, illustratively identified as arrow "C" in FIG. 4, in order to decrease the temperature of water delivered to the spray outlet 76. Both the lever 92 and the wheel 96 may be positioned within the housing 72 such that each may be moved with the thumb of a user who is simultaneously gripping the trigger 88. It should be appreciated that the lever 92 and the wheel 96 are illustrative control members 90, and that additional embodiments may be substituted therefor.

Figure 6:
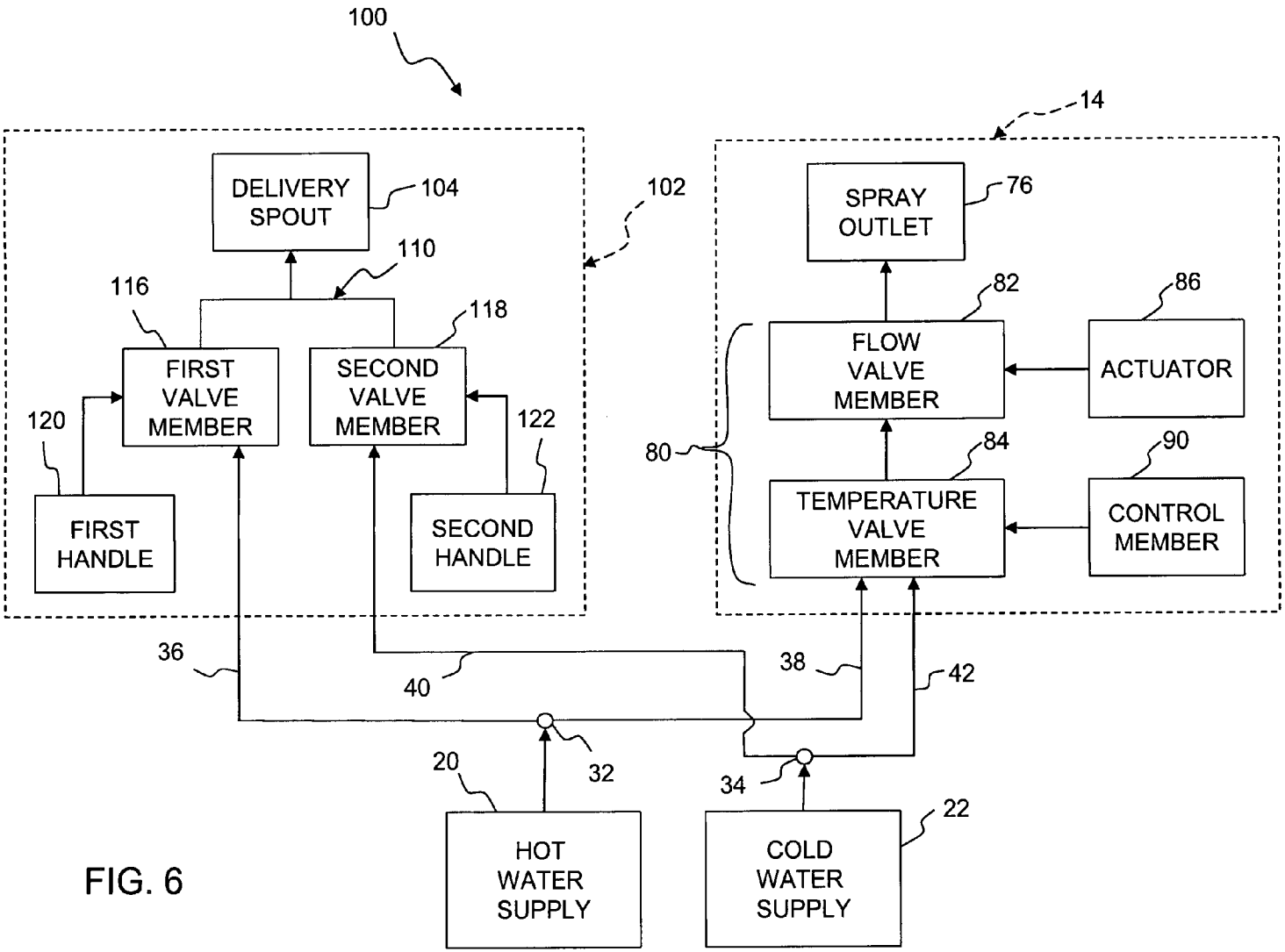
FIG. 6 is a block diagram of the illustrative embodiment fluid delivery system of FIG. 5.

While the embodiments of FIGS. 2 and 6 illustrate a control valve assembly 80 including the flow valve number 82 separate from the temperature valve member 84, it should be appreciated that other control valve assemblies 80 may be substituted therefor. More particularly, the control valve assembly 80 may include a single valve member configured to control both the flow and the temperature of water delivered to the spray outlet 76. In such an embodiment, a single handle could serve as both actuator 86 and control member 90 for controlling the valve assembly 80. Such a valve assembly 80 could be similar to the ball valve member 50 detailed above with respect to the control valve 48 of the faucet 12.

Figure 5:
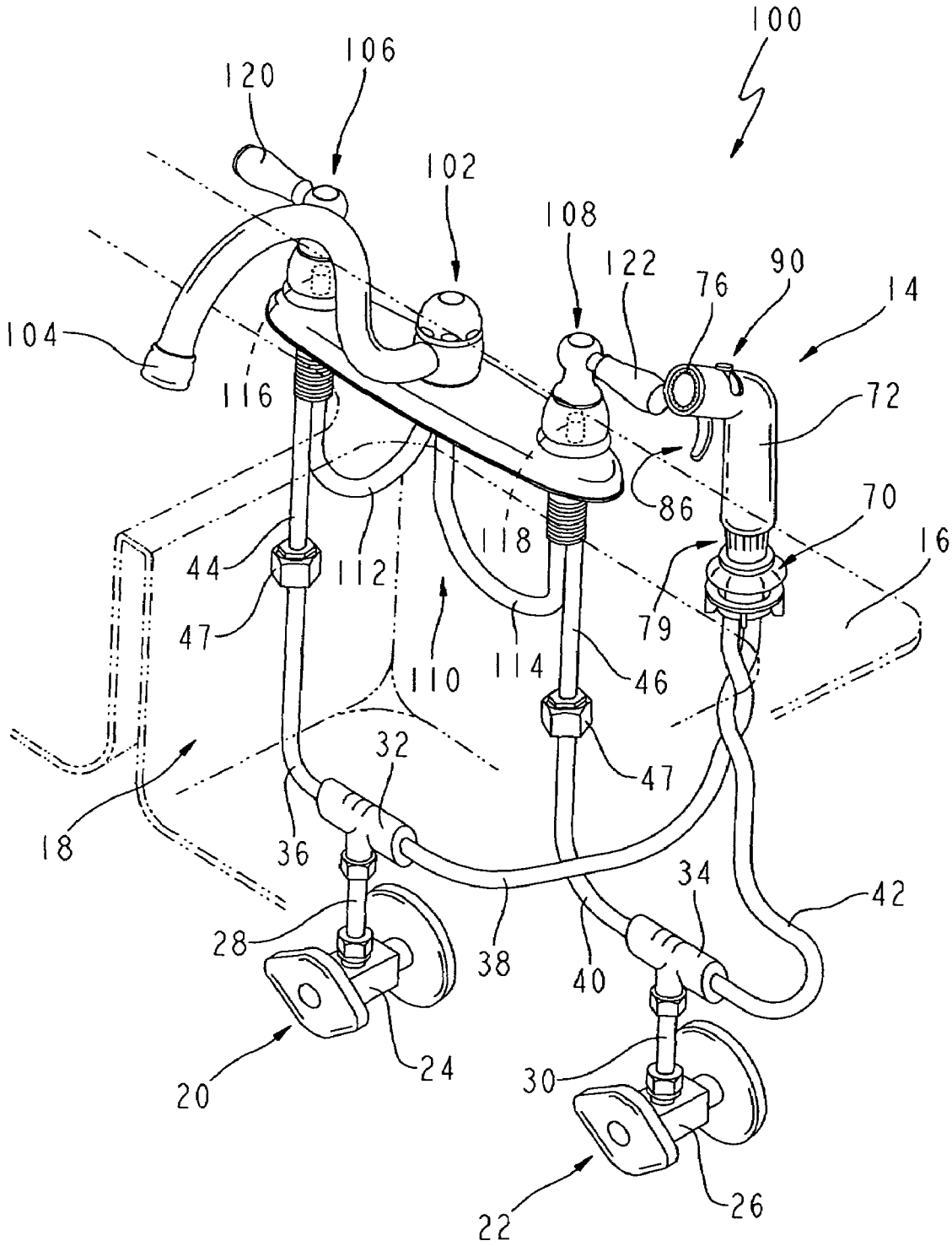
FIG. 5 is a perspective view of a further illustrative embodiment fluid delivery system according to the present invention.

Turning now to FIG. 5, an alternative embodiment of the fluid delivery system 100 of the present invention is illustrated as including faucet 102 and hand-held sprayer 14. It should be noted that similar components in FIGS. 1 and 5 are identified with like reference numbers.

The faucet 102 in FIG. 5 is a two-handle embodiment including a delivery spout 104 fluidly coupled to first and second control valves 106 and 108 through a fluid coupling 110, illustratively tubular members 112 and 114. First hot water distribution line 36 fluidly couples the first connector 32 to first or hot input supply tube 44 of the faucet 102. Likewise, first cold water distribution line 40 fluidly couples the second connector 34 to second or cold input supply tube 46 of the faucet 102. First input supply tube 44 is fluidly coupled to the first control valve 106, while second input supply tube 46 is fluidly coupled to the second control valve 108.

The first control valve 106 includes a first valve member 116 and the second control valve 108 includes a second valve member 118. Both valve members 116 and 118 are illustratively of conventional design and are configured to control the flow rate of water supplied to the delivery spout 104. More particularly, the valve member 116 controls the flow rate of hot water from the first input supply tube 44 to the tubular member 112, while the valve member 118 controls the flow rate of cold water from the second input supply tube 46 to the tubular member 114. The first valve member 116 is operably coupled to a first handle 120, while the second valve member 118 is operably coupled to a second handle 122.

In operation, the flow and the temperature of water supplied to the delivery spout 58, 104 of the faucet 12, 102 is controlled by operation of the respective control valve(s)

48 and 106, 108 through movement of handles 52 and 120, 122. However, the flow and temperature of water supplied to the spray outlet 76 of the hand-held sprayer 14 is independently controlled by operation of the control valve 80, illustratively through operation of the flow valve member 82 and the temperature valve member 84, respectively. Moreover, the control valve 80 of the sprayer 14 is independently controllable relative to the control valve 48 of the faucet 12 illustrated in FIG. 1. Likewise, the control valve 80 of the sprayer 14 is independently controllable relative to the control valves 106 and 108 of the faucet 102 illustrated in FIG. 5.

As such, the user may control the flow of water delivered from the faucet 12, 102 by delivering water from the delivery spout 58, 104 at a first flow rate. Similarly, the user may control the flow of water delivered from the hand-held sprayer 14 by delivering water from the spray outlet 76 at a second flow rate. The second flow rate may be set independently from, and have a different value than, the first flow rate. For example, the user may control the respective valves 48, 106, 108 and 80 such that (1) water is delivered from the spray outlet 76 but not from delivery spout 58, 104, (2) water is delivered from the delivery spout 58, 104 but not from the spray outlet 76, or (3) water is delivered simultaneously from both the delivery spout 58, 104 and the spray outlet 76 at the same or at different flow rates.

Similarly, the user may set a first temperature for water delivered from the delivery spout 58 and set a second temperature for water delivered from the spray outlet 76. The second temperature may be set independently from, and have a different value than, the first temperature. The first temperature is set by controlling the respective control valve(s) 42, 106, 108 of the faucet 12, 102, while the second temperature is set by controlling the control valve 80 of the sprayer 14.

It should be appreciated that the fluid delivery system 10, 100 permits independent operation of the faucet 12, 102 and the hand-held sprayer 14. More particularly, the flow and the temperature of water delivered from the spray outlet 76 of the hand-held sprayer 14 may be controlled independently from the flow and the temperature of water delivered from the delivery spout 58, 104 of the faucet 12, 102. As such, a user does not need to operate the faucet handle(s) 52, 120, 122 in order to operate the hand-held sprayer 14. In other words, the faucet 12 may be operated with one set of parameters for water flow and temperature, and the sprayer 14 may be operated with another set of parameters for water flow and temperature. Further, the fluid delivery system 10, 100 does not require a diverter valve to switch water flow between the delivery spout 58, 104 and the sprayer 14.

Although the invention has been described in detail with reference to certain preferred embodiments, variations and modifications exist within the spirit and scope of the invention as described and defined in the following claims.

The invention claimed is:

1. A hand-held fluid delivery device including:

a housing configured to be held by the hand of a user;

a spray outlet supported by the housing;

an inlet supported by the housing;

at least one flexible tubular member configured to fluidly couple the inlet to a hot water supply and a cold water supply;

a valve assembly received within the housing intermediate the spray outlet and the inlet;

an actuator supported by the housing and operably coupled to the valve assembly for controlling the flow of water to the spray outlet; and a control member supported by the housing and operably coupled to the valve assembly for controlling the temperature of water to the spray outlet, wherein the valve assembly includes a first valve member configured to control the flow of water to the spray outlet, and a second valve member configured to control the temperature of water delivered to the spray outlet.

2. A hand-held fluid delivery device including:

a housing configured to be held by the hand of a user;

a spray outlet supported by the housing;

an inlet supported by the housing;

at least one flexible tubular member configured to fluidly couple the inlet to a hot water supply and a cold water supply;

a valve assembly received within the housing intermediate the spray outlet and the inlet;

an actuator supported by the housing and operably coupled to the valve assembly for controlling the flow of water to the spray outlet; and a control member supported by the housing and operably coupled to the valve assembly for controlling the temperature of water to the spray outlet, wherein the actuator comprises a pivotably supported trigger handle.

3. The hand-held fluid delivery device of claim 1, wherein the control member is supported for movement relative to the housing.

4. The hand-held fluid delivery device of claim 3, wherein the control member comprises a lever supported for pivoting movement relative to the housing.

5. The hand-held fluid delivery device of claim 3, wherein the control member comprises a wheel supported for rotating movement relative to the housing.

6. The hand-held fluid delivery device of claim 1, wherein the first valve member is a two position type valve.

7. The hand-held fluid delivery device of claim 1, wherein the first valve member is spaced apart from the second valve member.

8. The hand-held fluid delivery device of claim 1, wherein the first valve member is positioned between the second valve member and the spray outlet.

9. The hand-held fluid delivery device of claim 1, wherein the actuator is positioned to be moved by the fingers of an operator and the control member is positioned to be moved by the thumb of the operator, thereby providing single hand control of the actuator and the control member.

10. The hand-held fluid delivery device of claim 1, wherein the at least one flexible tubular member includes a hot water distribution line and a cold water distribution line.

11. The hand-held fluid delivery device of claim 1, wherein the control member extends above a top surface of the housing.

12. The hand-held fluid delivery device of claim 2, wherein the control member is supported for movement relative to the housing.

13. The hand-held fluid delivery device of claim 12, wherein the control member comprises a lever supported for pivoting movement relative to the housing.

14. The hand-held fluid delivery device of claim 12, wherein the control member comprises a wheel supported for rotating movement relative to the housing.

15. The hand-held fluid delivery device of claim 2, wherein the actuator is positioned to be moved by the fingers of an operator and the control member is positioned to be moved by the thumb of the operator, thereby providing single hand control of the actuator and the control member.

16. The hand-held fluid delivery device of claim 2, wherein the at least one flexible tubular member includes a hot water distribution line and a cold water distribution line.

17. The hand-held fluid delivery device of claim 2, wherein the control member extends above a top surface of the housing.

* * * * *